United States Patent [19]

Bier et al.

[11] Patent Number: 5,055,163

[45] Date of Patent: Oct. 8, 1991

[54] PROCESS FOR PRODUCING A TWO-DIMENSIONALLY EXTENDING METALLIC MICROSTRUCTURE BODY WITH A MULTITUDE OF MINUTE OPENINGS AND A TOOL SUITABLE FOR THIS PURPOSE

[75] Inventors: Wilhelm Bier, Egg-Leopoldshafen; Asim Maner, Linkenheim; Klaus Schubert, Karslruhe, all of Fed. Rep. of Germany

[73] Assignee: Kernforschungszentrum Karlsruhe GmbH, Fed. Rep. of Germany

[21] Appl. No.: 452,456

[22] Filed: Dec. 18, 1989

[30] Foreign Application Priority Data

Dec. 17, 1988 [DE] Fed. Rep. of Germany ..... 3842610

[51] Int. Cl.[5] ..... C25D 1/08

[52] U.S. Cl. ..... 204/11

[58] Field of Search ..... 204/11

[56] References Cited

U.S. PATENT DOCUMENTS 2,805,986 9/1957 Law ..... 204/11

FOREIGN PATENT DOCUMENTS 3537483 4/1986 Fed. Rep. of Germany .
3611732 10/1987 Fed. Rep. of Germany .
591570 9/1977 Switzerland .

*Primary Examiner*—T. M. Tufariello
*Attorney, Agent, or Firm*—Sughrue, Mion, Zinn Macpeak & Seas

[57] ABSTRACT

The invention relates to a process for producing a two-dimensionally extending metallic microstructure body having a multitude of minute openings the dimensions and distribution of which may be predetermined. A tool having microstructures on the surface thereof, which microstructures taper outwardly, is pressed into the electrically insulating layer of a molding material comprising an electrically insulating layer and an electrically conducting layer, so that the microstructures project at least through the insulating layer, to form an impression in the molding material. The tool is withdrawn from the molding material to form an impression in the molding material comprised of openings which taper in the direction of the electrically conducting layer. The impression of the molding material is electroplated with a metal to fill the openings with metal to form a two-dimensionally extending metallic microstructure having adjacent metal fillings and minute openings, by filling the openings in the impression to a height at which the distance between adjacent fillings corresponds at the surface of the fillings to the predetermined dimensions of the two-dimensionally extending metallic microstructure. The molding material is removed from the two-dimensionally extending metallic microstructure.

6 Claims, 4 Drawing Sheets

FIG. 1(a)
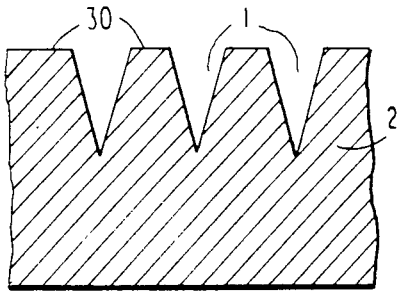
FIG. 1(b)
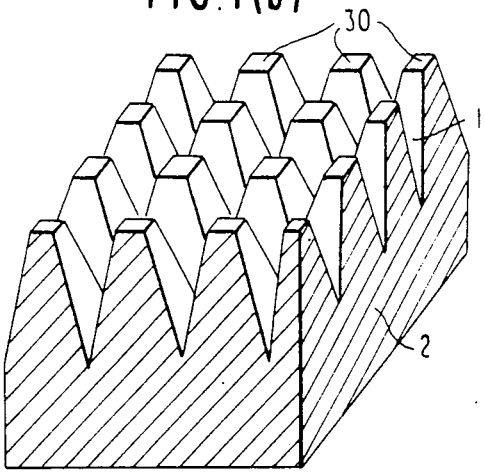
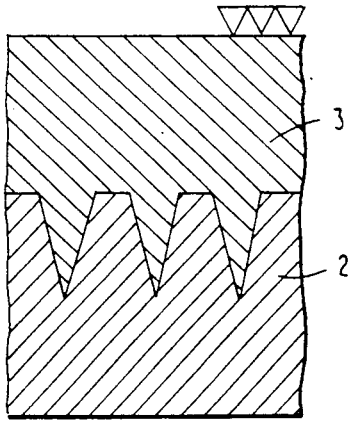
FIG. 2
FIG. 3(a)
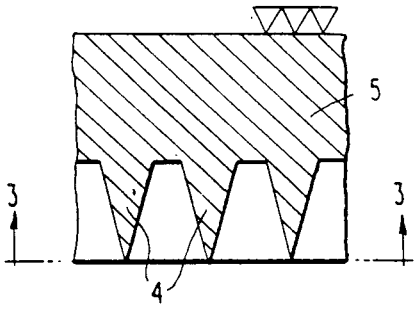
FIG. 3(b)
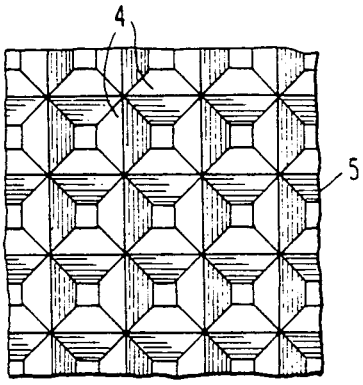

FIG. 4
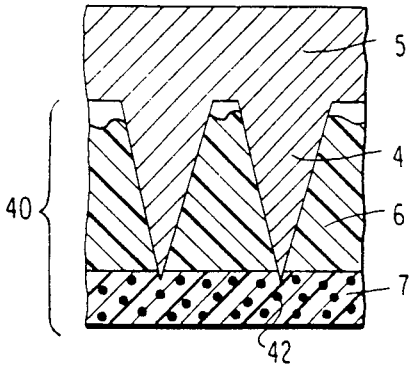
FIG. 5(a)
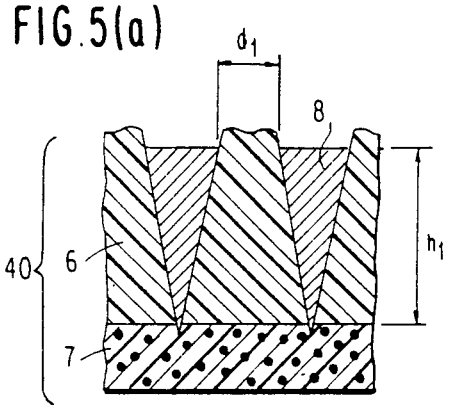
FIG. 6(a)
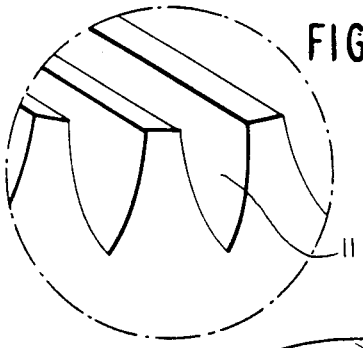
FIG. 5(b)
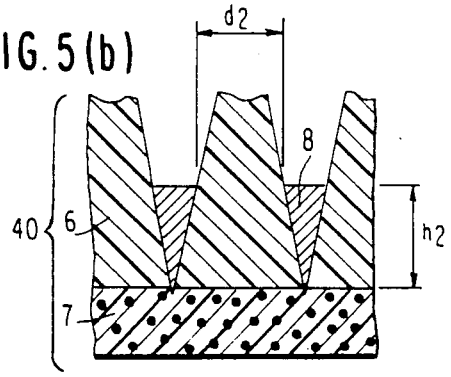
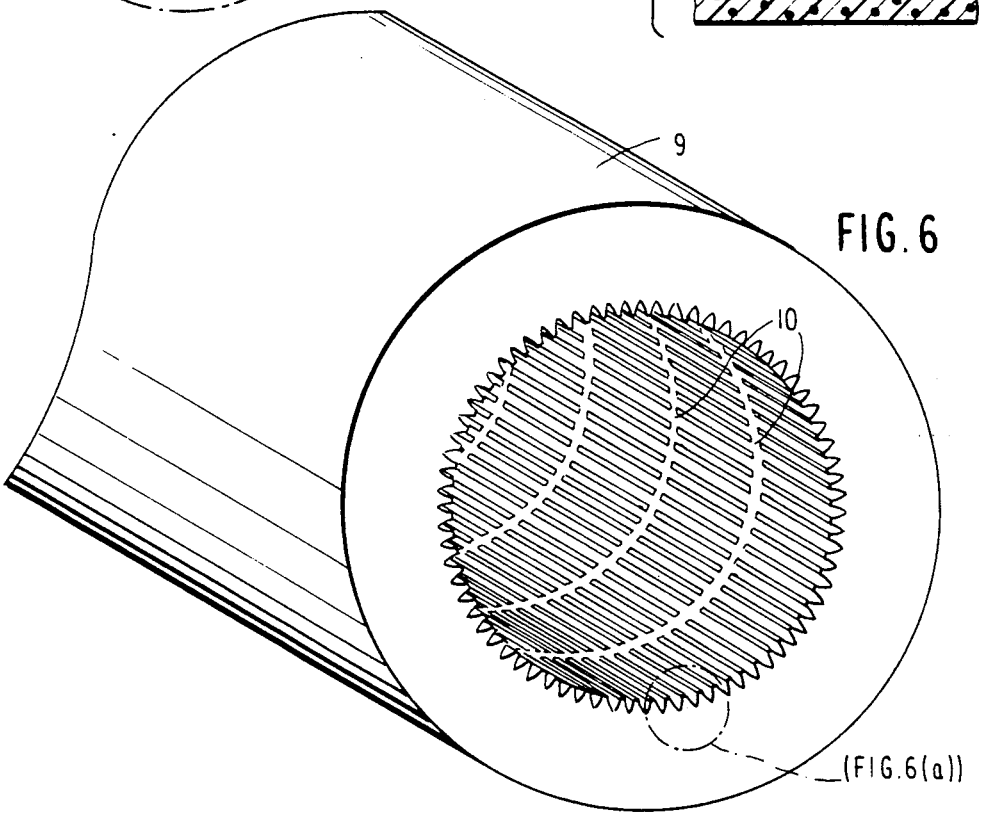
FIG. 6

FIG. 7
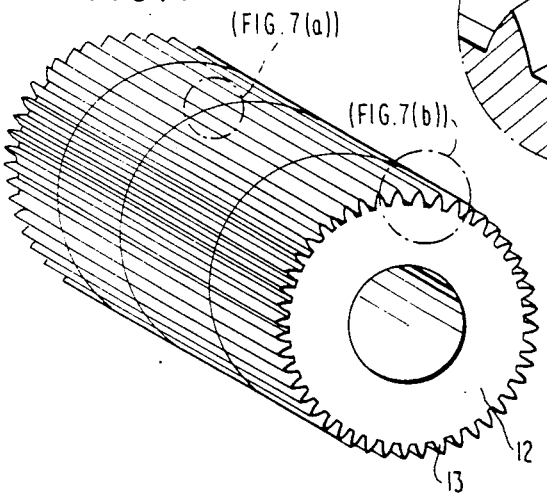
FIG. 7(a)
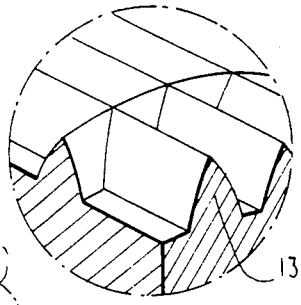
FIG. 7(b)
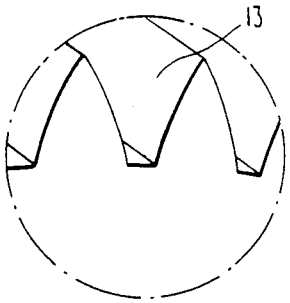
FIG. 8
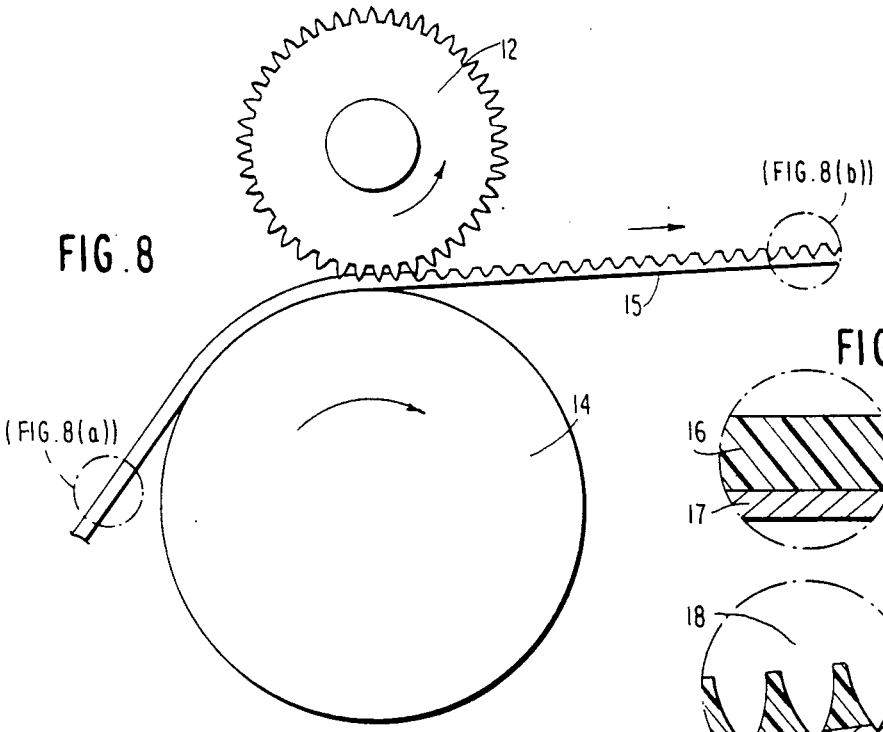
FIG. 8(a)
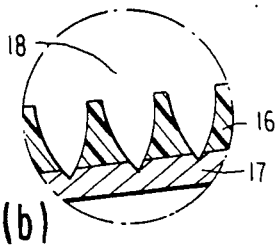
FIG. 8(b)

PROCESS FOR PRODUCING A TWO-DIMENSIONALLY EXTENDING METALLIC MICROSTRUCTURE BODY WITH A MULTITUDE OF MINUTE OPENINGS AND A TOOL SUITABLE FOR THIS PURPOSE

FIELD OF THE INVENTION

The present invention relates to a process for producing a two-dimensionally extending metallic microstructure body having numerous minute openings of preselected measurements and distribution, and to a tool for such a process.

BACKGROUND OF THE INVENTION

Processes for producing a two-dimensionally extending metallic microstructure are known in which a molding tool is formed having a surface which comprises numerous microstructures. The two-dimensionally extended microstructure body may, for example, be a foil or plate which is used for filtering liquids or is used as a diffraction grating.

The molding tool which contains a microstructure body is used to form a female mold corresponding to the shape of the microstructure body. The female mold is made from a molding material which comprises a composite body in the form of an electrically-insulating layer and an electroconductive layer. In order to make the female mold, the microstructures of the tool can be pressed through the electrically-insulating layer into the electroconductive layer. The tool containing the microstructure body is then withdrawn from the composite body to form an impression or negative imprint in the composite body. The female mold thus produced can, by using the electroconductive layer as a cathode, be electroplated with a metal to form a metallic microstructure body. The female mold can then be removed from the new microstructure body. The molding tool can then be reused to form a new female mold and the process can be repeated.

Microstructure bodies may be produced by either of two different methods: (1) photolithography combined with electroplating or (2) the process disclosed in German PS 35 37 483. This latter process is called the "LIGA" (deep-Etch x-ray lithography-microelectroforming) process.

It is also apparent from the German Offenlegungsschrift DE-OS 36 11 732 that for producing catalyst-carriers, individual plate-shaped microstructure bodies, produced by the LIGA process, can be aligned and combined into a solid structure.

In the method where photolithography is used in conjunction with electroplating, thin resist layers are generally used because, the structuring of thick photoresists creates problems. The adjustment of the opening sizes is accomplished by freely growing an electroplated layer above the resist structure. The photolithography method is based on the irradiation of a resist layer by UV light. The UV-radiation penetrates the resist layer only to a depth of about 50 μm to 100 μm at best. The predetermined size of the openings can be adjusted as a function of the thickness of the electroplated layer. However, transparency is thereby greatly reduced, particularly as the size of the openings decreases. Therefore, high transparencies, small openings, and thick plates cannot be realized simultaneously. Moreover, the achievable tolerances for these openings are consequently highly dependent on the parameters of the electroplating bath.

The LIGA process in accordance with German PS 35 37 483 cannot produce microstructures in which the cross sectional form changes by means of the height of the microstructure. In other words, the opening dimensions cannot be adjusted through the height of the electroplate layer.

Those working in the art are therefore faced with the problem of avoiding the above-mentioned disadvantages.

SUMMARY OF THE INVENTION

An object of the present invention is to provide a process for producing two-dimensionally extending microstructure bodies which avoid the above problems.

A further object of the present invention is to provide a process which can repeatedly (serially) produce two-dimensionally extending microstructure bodies, such as foils or plates, which have a multitude of minute openings or slots, the dimensions and distribution of which can be freely determined.

It is a another object of the present invention to produce a tool with which the microstructure bodies can be produced.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

These and other objects are accomplished by a process for producing a two-dimensionally extending metallic microstructure body having a multitude of minute openings the dimensions and distribution of which can be predetermined, comprising the steps of: (a) pressing a tool having microstructures on the surface thereof, which microstructures taper outwardly, into the electrically insulating layer of a molding material which comprises an electrically insulating layer and an electrically conducting layer, so that the microstructures project at least through the insulating layer, (2) withdrawing the tool from the molding material to form an impression in the molding material comprised of openings which taper in the direction of the electrically conducting layer, (3) electroplating the impression of the molding material with a metal to fill the openings with metal to form a two-dimensionally extending metallic microstructure having adjacent metal fillings and minute openings and by filling the openings in the impression to a height at which the distance between adjacent fillings corresponds to the surface of the fillings to the predetermined dimensions of the openings of the two dimensionally extending metallic microstructures, and (4) removing the molding material from the two-dimensionally extending metallic microstructure.

The tool for use in the present invention for making a plate-shaped microstructure body is made by first providing the a machinable substrate forming closely adjoining slots in the substrate by means of one or more shaped diamonds, wherein the slots narrow toward their base. The thus-structured surface of the substrate, which is an original structure, is then employed as a mold wherein a metal or a ceramic material is deposited on the structured surface of the substrate, and the substrate is then removed from the metal or ceramic material to leave behind a tool having a molded surface.

It is to be understood that both the foregoing general description and the following detailed description are exemplary and explanatory, but are not restrictive of the invention.

BRIEF DESCRIPTION OF THE DRAWINGS

FIG. 1(*a*) is a schematic, cross-sectional view of an original structure in the form of a metal plate which is structured by slots and which is used to form a molding tool in accordance with one embodiment of the present invention.

FIG. 1(*b*) is a schematic, perspective view of the metal plate structured by slots of FIG. 1(*a*).

FIG. 2 is a schematic, cross-sectional view of the metal plate of FIGS. 1(*a*) and 1(*b*) after it has been electroplated with metal.

FIG. 3(*a*) is a schematic, cross-sectional view of the metal of one embodiment of a tool of the present invention.

FIG. 3(*b*) is a schematic bottom view of the tool of FIG. 1 looking in the direction of the lines 3—3.

FIG. 4 is a schematic, cross-sectional view of the tool of FIG. 3(*a*) penetrating into a composite molding layer.

FIG. 5 (*a*) is a schematic, cross-sectional view of the composite layer whose impressions are electroplated in accordance with one embodiment of the present invention to a height $h_1$.

FIG. 5 (*b*) is a schematic, cross-sectional view of the composite layer whose impressions are electroplated in accordance with another embodiment of the present invention to a height $h_2$.

FIG. 6 is a perspective of another original structure in the form of a hollow cylinder and which is used to form a molding tool in accordance with another embodiment of the present invention.

FIG. 6(*a*) is an expanded view of a circled portion of FIG. 6.

FIG. 7 is a perspective view of a tool having a microstructured outer surface formed from the original structure of FIG. 6.

FIG. 7(*a*) is an expanded view of a first slotted portion, within a first circle designated FIG. 7(*a*), of FIG. 7.

FIG. 7(*b*) is an expanded view of a second slotted portion, within a second circle designated FIG. 7(*b*), of FIG. 7.

FIG. 8 is a schematic view of the tool of FIG. 7 pressing into a composite molding layer.

FIG. 8(*a*) is an expanded view of a first circled portion of FIG. 8, designated as circled portion FIG. 8(*a*) of FIG. 8.

FIG. 8(*b*) is an expanded view of a second circled portion of FIG. 8, designated as circled portion FIG. 8(*b*) of FIG. 8.

FIG. 9(*b*) is a schematic, cross-sectional view of the metal foil of FIG. 9(*a*), illustrating the width between the slots, taken along lines A—A.

FIG. 9(*c*) is a schematic, cross-sectional view of the metal foil of FIG. 9(*a*), illustrating the width between the reinforcing ribs, taken along lines B—B.

DETAILED DESCRIPTION OF THE INVENTION

Figure 9A:
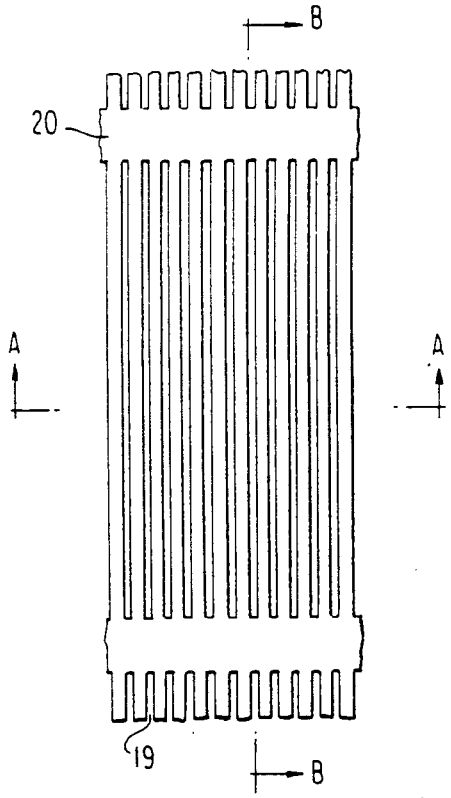
FIG. 9(*a*) is a plan view of a metal foil prepared according to one embodiment the process of the present invention by employing the arrangement of FIG. 8.

A metal plate comprised of, for example, copper or an aluminum-magnesium alloy ($AlMg_3$) can be used as a machinable substrate which can be machined to form an original structure having microstructures which taper. This original structure can then be electroplated with another metal, nickel, for example, to form a tool having a microstructure surface which corresponds to the microstructured of the original structure.

A composite body comprises of an electroconductive molding compound layer and an electrically-insulating molding compound layer can also be used as the machinable substrate into which tapered slots or openings are formed by a molding tool at such depth that they reach into the electroconductive layer, whereupon the openings can be filled with metal by electroforming of metal by using the electroconductive layer as a cathode and subsequently removing the substrate to thereby leave behind a metallic microstructure body.

When forming the microstructures by employing a molding tool, it has been shown to be advantageous to insert the molding tool into the molding material and subsequently to remove it with the help of ultrasound. When using ultrasound, heating the composite layer during the molding process is not necessary. Moreover, molding of the composite layer with the molding tool is expedited by the tapered form of the microstructures compared to molding microstructures which have straight walls.

Compared to photolithography in combination with electroplating, the present invention achieves a significantly higher transparency with a comparable opening dimension and a comparable thickness, whereby closer tolerances can also be achieved.

Contrary to the LIGA procedure, the present invention allows the production of an opening size which varies with the height of the composite body as well as of an expanding opening, which is advantageous for producing a metallic network which is to be used for filtering.

The present invention will be illustrated further by the following examples, but the invention should not be construed as being limited thereto.

EXAMPLE 1

Step a)—Making the Tool

As the starting material for producing the tool, a $20\times30$ mm$^2$ plate of $AlMg_3$ is used as a machinable substrate.

The surface of the $AlMg_3$ plate is micro-structured by processing it crosswise with a wedge-shaped microdiamond without a chamfer at its tip to form an original structure. The slots created thereby have a depth of 100 micrometers and an opening angle of 53°. The density of the slots is 9.1 slots per mm. The microstructures of the original structure may have the form of pyramids with the bases of the pyramids supported on the substrate.

Referring now to FIGS. 1*a* and 1*b*, there is shown a metal plate 2 which has been processed with a microdiamond to create slots 1 which define microstructures 30 structured by slots 1. Metal plate 2 is an original structure having microstructures 30 in the form of pyramids.

A layer of nickel 3 is then deposited by electroplating on metal plate 2 as shown in FIG. 2.

The layer of nickel is surface grinded on its open surface.

Metal plate 2 is subsequently dissolved away from nickel layer 3 in a suitable caustic solution, e.g., soda lye, to thereby obtain a nickel tool 5 having tapered microstructures 4 as shown in FIG. 3*a*. Microstructures 4 of tool 5 taper outwardly, that is, they decrease in cross-section as they extend outwardly from the tool.

Step b)—Molding the Microstructures 4 of Tool 5

A composite molding layer 40 is created out of an electrically-insulating layer 6, comprised of a thermoplastic polymethyl methacrylate (PMMA), and an electroconductive layer 7, comprised of thermoplastic PMMA containing imbedded graphite particles 42.

Such materials as polypropylene, polyethylene, polycarbonate, polystyrene, ABS, PVC, polyacetal and polyamide can also be used as thermoplastics.

Electroconductive layer 7 can also comprise a metal or a metallic alloy with a low melting point, such as an alloy of lead, tin and optionally bismuth.

Composite layer 40 is appropriately made in such a way that electroconductive layer 7 first is coated onto a metal plate or metal foil (not shown) and hardened. The hardened electroconductive layer 7 then is covered by coating electrically-insulating layer 6 over it and hardening the electrically-insulating layer. Composite layer 40 is further processed in hardened form.

Tool 5, produced in accordance with Step a), is pressed into composite layer 40 until microstructures 4 of tool 5 penetrate through electrically-insulating layer 6 into electroconductive layer 7, as shown in FIG. 4.

Tool 5 is then removed from composite layer 40 to thereby form an impression or negative imprint of microstructures 4 in composite layer 40. The impression is comprised of openings which taper in the direction of electrically conductive layer 7, that is, the openings decrease in cross-section in the direction of layer 7.

Step c)—Electroplate Filling of the Negative Form

The impression or negative form produced in composite layer 40 in Step b) then is electroplated with a metal to fill the impression with a metallic filling 8 by employing the electroconductive layer 7 as a cathode to thereby fill the openings, as shown, for example, in FIGS. 5(*a*) and 5(*b*).

Height h of the electrodeposited filling 8, as represented by $h_1$ in FIG. 5*a* and $h_2$ in FIG. 5*b*, determines both the transparency and the opening size d of the plate-shaped microstructure body. The metals nickel, gold and copper are particularly well suited as filling material.

Composite layer 40 is then removed. This can be accomplished, for instance, by dissolving it with dichloromethane after which the electrodeposited metallic filling 8 of the negative form remains. A lattice-shaped metallic net results, with structures of triangular cross sections and expanding openings, the diameters d of which, represented by $d_1$ in FIG. 5*a* and $d_2$ in FIG. 5*b*, can be adjusted through the height of the electrodeposited filling, which corresponds to the thickness of the metallic net. At a height h of 70 μm of the electrodeposited metallic filling 8, square openings with the dimensions d=40 μm are obtained, as schematically represented in FIG. 5*a*. The transparency of the metallic net or the opening ratio, which is calculated as the ratio of the sum of the available openings to the total area of the metallic net, is about 13 percent in this case. However, if height h of the electrodeposited metallic filing is chosen to be 50 μm, as schematically represented in FIG. 5*b*, then the openings created in the metallic net have the dimension of d=60 μm and the transparency is about 30 percent. By a corresponding selection of the angle of the wedge-shaped diamond, other values and transparencies can, of course, be realized in the metallic net as a function of the height of the electrodeposited filling.

EXAMPLE 2

Step a)—Production of a Cylindrical Tool

A hollow copper cylinder 9, as shown in FIG. 6 which has an exterior diameter of 170 mm and an interior diameter of 120 mm, is provided with tapered slots 11 on its internal surface parallel to the cylinder axis, as shown in FIG. 6(*a*). At greater intervals, transverse slots 10 are provided vertically to the cylinder axis which are wider than the longitudinal slots. Slots 11 have a depth of 240 μm and a maximum width of 200 μm, while the transverse slots have a depth of 240 μm and a width of 400 μm. The density of slots 11 is 3.5 slots per mm.

Hollow cylinder 9, provided with longitudinal slots 11 and transverse slots 10, is then electroplated. To accomplish this, a thin rod (not shown) is inserted along the cylinder axis of cylinder 9, centered and employed as an anode.

Hollow cylinder 9 itself serves as the cathode. By this arrangement, nickel is deposited on the inside of hollow cylinder 9 until the internal diameter is reduced to a freely determined (predetermined) desired value, for instance, to the diameter of a shaft. The inner, structured surface of hollow cylinder 9 is thereby transferred to the electrodeposited metal as a negative form.

After depositing is complete, the anode is withdrawn from the partially filled hollow cylinder, and the remaining open internal surface of the electroplated hollow cylinder is ground to be dynamically balanced and polished.

Now the originally used hollow copper cylinder 9 is selectively removed by dissolution with a $CuCl_2$ solution, whereby the electroplated nickel which was deposited on the inside of hollow copper cylinder 9 remains as tool 12.

FIGS. 7, 7(*a*) and 7(*b*) show the thus-produced tool 12 with its molded microstructures 13 on its exterior surface. Tool 12 has an outside diameter of 120 mm and an inside diameter of 60 mm and is 260 mm long.

If longitudinal slots 11 or transverse slots 10 must be chosen to be very narrow and deep, it may happen that the hollow copper cylinder having such an interior microstructure cannot be completely electroplated with metal. Hollow spaces may occur in tool 12 in the areas of the slots, as represented by the two circled portions shown in FIG. 7. In this case, it is recommended that in place of hollow cylinder 9, which is made of pure copper or some other metal, another hollow cylinder be provided as an original structure, also made of copper, for instance, which on its interior surface is thinly coated with an electrically-insulating material such as PMMA or some other insulating plastic. The thickness of the insulating layer should be smaller than the height of slots 10 and 11 to be formed, so that the slots penetrate through the layer of electrically-insulating plastic and continue into the metal. This will greatly expedite a true-to-form electroplating.

After electroplating, the metal of the original hollow cylinder structure is removed, and then the layer of electrically-insulating plastic is removed, if PMMA has been used, by a dichloromethane solvent, for instance, to thereby leave behind a tool.

Step b)—Molding A Composite Layer With The Tool

Analogous to Step b) of Example 1, a flexible composite layer 15 is produced, whereby an electrically-insulating layer 16 and an electroconductive layer 17 are now individually produced in advance in the form of foils by rollers, and then are subsequently bonded together. The material used for the electrically-insulating layer 16 is polypropylene. The material used for electroconductive layer 17 is a metal alloy with a low melting point, preferably a lead-tin alloy.

FIGS. 8, 8(*a*), 8(*b*) show the molding of composite layer 15 by tool 12. Composite layer 15 is passed between two adjoining rollers, one of which is tool 12 produced in Step a) and the other of which is a smooth roller 14. To expedite molding and to limit the pressure exerted by rollers 12 and 14 on composite layer 15, composite layer 15 can be warmed by an infrared radiator (not shown) immediately before it is inserted between the pair of rollers 12 and 14.

Composite layer 15 is fed between rollers 12 and 14 in such a way that the microstructures of roller 12 penetrate through electrically-insulating layer 16 of composite layer 15 into electroconductive layer 17 of composite layer 15 to produce a negative form or impression 18.

Step c)—Filling of the Negative Form by Electroforming

The negative form 18 produced in this manner on the molded composite layer 15 is filled with nickel by electroforming as described in Example 1, Step c). To this end, the molded composite layer 15 is electrodeposited in a conveyor installation as a continuous strip, after which the electrodeposited metal filling is wound on a spool as a continuous, metal, slotted-foil, by stripping it from composite layer 15.

Figure 9B:
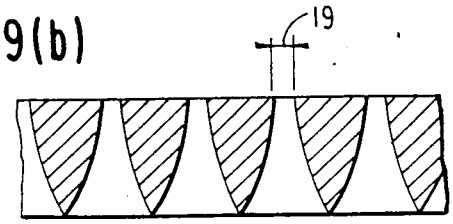
Figure 9C:
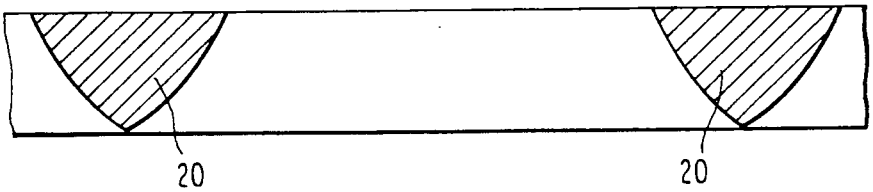

The result of this process is shown in FIG. 9. A continuous nickel foil with slots 19 and with reinforcing ribs 20 is the result. The width of slot 19 is adjustable through the height of the electrodeposited nickel layer as shown in Step c) of Example 1. In the present example, with a slotted-foil thickness of 120 μm, which corresponds to the height of the electro-deposited layer, a slot width of 125 μm is achieved and, not considering the reinforcing ribs, a transparency of about 44 percent.

The slotted-foil produced in this manner can be used as an optical grating or as a vaporization mask.

EXAMPLE 3

Molding the Tool with Ultrasound

In case a lattice-shaped metal net is to be produced analogous to Example 1, use of the metal tool in accordance with Step b) of Example 1 with ultrasound is advantageous.

A composite layer is produced as a first step. This composite layer can be produced by the following three different techniques.

a) In the first technique, a thermoplastic layer treated with electroconductive particles such as graphite powder, for example, is coated onto a flat base. This first layer forms the electroconductive layer of the composite layer to be produced.

After the electroconductive layer hardens, a second unadulterated thermoplastic layer is coated over the first electroconductive layer. Polypropylene, polyethylene, PMMA, polycarbonate, PVC, polystyrene, ABS (alkyl-benzenesulfonate), polyacetal or polyamide can be used as the thermoplast. The second thermoplastic layer constitutes the electrically-insulating layer of the composite layer.

b) In a second technique, an electroconductive layer is formed by using a metal or a metallic alloy with a low melting point. An alloy of lead, tin, and possibly bismuth, is a suitable example.

The production of the composite layer otherwise proceeds analogous to technique a), that is, an electrically-insulating layer is coated onto the electrically conducting layer.

c) In a third technique, an electrically insulating foil layer in accordance with techniques a), or b), can be coated onto a metal plate made, for instance, of aluminum.

The plate-shaped tool is fastened onto the sonotrode (horn) of an ultrasonic welding machine. The fastening can be done by gluing or soldering. The composite layer is placed with its electroconductive layer on the anvil of the ultrasonic sealing machine. The anvil is equipped with suction holes which are connected to a vacuum pump, a vacuum container, or some other suitable device. Because of the vacuum, the composite layer adheres to the anvil.

Shaping with the metal tool takes place analogous to Example 1, Step b), whereby, the tool, however, is pressed into the composite layer and removed again while applying ultrasound during the pressing and removal.

The other processing steps correspond to Example 1.

It will be understood that the above description of the present invention is susceptible to various modifications, changes and adaptations, and the same are intended to be comprehended within the meaning and range of equivalents of the appended claims.

What is claimed is:

1. A process for producing a two-dimensionally extending metallic microstructures body having a multitude of minute openings the dimensions and distribution of which are predetermined, comprising the steps of:

a) pressing a tool having microstructures on the surface thereof, wherein the microstructure of the tool taper outwardly, into the electrically insulating layer of a molding material comprising an electrically insulating layer and an electrically conducting layer, so that the microstructures project at least through the insulating layer, b) withdrawing the tool from the molding material to form an impression in the molding material comprised of openings which taper in the direction of the electrically conductive layer, c) electroplating the impressions of the molding material with a metal to fill the openings with metal, to form a two-dimensionally extending metallic microstructure having adjacent metal fillings and minute openings by filling the openings in the impression to a height at which the distance between adjacent fillings corresponds at the surface of the fillings to the predetermined dimensions of the openings of the two-dimensionally extending metallic microstructure, and d) removing the molding material from the two-dimensionally extending metallic microstructure.

2. The process of claim 1, wherein the tool is inserted into and withdrawn from the molding material while applying ultrasound.

3. The process according to claim 1, wherein during the pressing, the microstructures of the tool project into the electrically conductive layer.

4. The process of claim 3, wherein the electrically conductive layer serves as a cathode during the electroplating step.

5. A process for preparing a tool which contains microstructures which taper outwardly from the surface of the tool, comprising providing a machinable substrate and forming closely spaced slots on the surface of the substrate by one or more shaped diamonds, wherein the slots taper in the direction of their base, to form a structured substrate, and depositing on the structured surface of the substrate metal or ceramic, and then removing the substrate from the metal or ceramic to form a tool having a molded surface.

6. The process of claim 5, wherein a metal plate is used as the substrate.

* * * * *

UNITED STATES PATENT AND TRADEMARK OFFICE

CERTIFICATE OF CORRECTION

PATENT NO. : 5,055,163

DATED : October 8, 1991

INVENTOR(S) : Wilhelm Bier, et al

It is certified that error appears in the above-identified patent and that said Letters Patent is hereby corrected as shown below:

Title page, item [21], Appl. No.: "452,456" should read --452,546--.

Signed and Sealed this

First Day of June, 1993

*Attest:*

Michael K. Kirk

MICHAEL K. KIRK

*Attesting Officer*

*Acting Commissioner of Patents and Trademarks*